US005081806A

United States Patent [19]

Pommelet

[11] Patent Number: 5,081,806

[45] Date of Patent: Jan. 21, 1992

[54] BUILDING STRUCTURE FOUNDATION SYSTEM

[76] Inventor: Yves M. Pommelet, 837 Canterbury Road, Victoria, British Columbia, Canada, V8X 3E5

[21] Appl. No.: 408,633

[22] Filed: Sep. 18, 1989

Related U.S. Application Data

[63] Continuation-in-part of Ser. No. 385,648, Jul. 25, 1989.

[51] Int. Cl.[5] ..... E02D 27/34

[52] U.S. Cl. ..... 52/167 R

[58] Field of Search ..... 52/167, 225, 723; 248/618, 630, 638

[56] References Cited

U.S. PATENT DOCUMENTS

| | | | |
|---|---|---|---|
| 1,162,956 | 12/1915 | Walsh et al. | 248/630 |
| 1,651,411 | 9/1926 | Porter | 52/167 |
| 1,761,659 | 6/1930 | Cummings | 52/167 |
| 2,001,169 | 5/1935 | Wallace | 72/77 |
| 2,035,143 | 3/1936 | Cavaglieri | 72/77 |
| 2,359,036 | 8/1943 | Harper | 52/167 |
| 2,750,118 | 6/1956 | Hastings et al. | 52/723 |
| 2,786,349 | 3/1957 | Coff | 52/723 |
| 3,347,002 | 10/1967 | Penkuhn | 52/167 |
| 3,835,607 | 9/1974 | Raaber | 52/723 |
| 4,125,978 | 11/1978 | Schiblge | 52/167 |
| 4,517,778 | 5/1985 | Nicolai | 52/167 |

FOREIGN PATENT DOCUMENTS

| | | | |
|---|---|---|---|
| 2494330 | 5/1982 | France . | |
| 0607890 | 5/1978 | U.S.S.R. . | |
| 706504 | 1/1980 | U.S.S.R. | 52/167 |
| 0857357 | 9/1981 | U.S.S.R. . | |
| 0896190 | 1/1982 | U.S.S.R. . | |
| 1020552 | 5/1983 | U.S.S.R. | 52/167 |
| 1079760 | 3/1984 | U.S.S.R. | 52/167 |

*Primary Examiner*—David A. Scherbel
*Assistant Examiner*—Michele A. Van Patten
*Attorney, Agent, or Firm*—Townsend and Townsend

[57] ABSTRACT

A foundation system for buildings and other structures absorbs both horizontal and vertical displacement from seismic earthquakes. The system comprises a fixed support base with a hardened three dimensional curved member located between a hardened dished top surface of the base and a hardened reverse dished cup on the underside of a concrete beam which has post tensioned members therein. The concrete beam is preferably cambered or curved and allows a certain amount of deflection and the three dimensional curved member, preferable an elliptical shape, allows horizontal displacement. In another embodiment the elliptical shaped curved member is formed in two halves with a spring in between to allow limited compression of the member.

8 Claims, 4 Drawing Sheets

PRIOR ART

BUILDING STRUCTURE FOUNDATION SYSTEM

This application is a continuation-in-part of U.S. application Ser. No. 385,648 filed July 25, 1989.

FIELD OF THE INVENTION

The present invention relates to a foundation system for buildings and other structures to absorb at least some of the seismic motion resulting from earthquakes and the like. More specifically the present invention provides a foundation system for a building structure which dampens out both horizontal and vertical displacement forces.

BACKGROUND OF INVENTION

In an earthquake, the ground generally has two motions, horizontal displacement and vertical displacement. Earthquakes produce seismic waves or ripples in the earth's crust. The horizontal displacement of such a ripple or wave causes a bending action on a building structure, particularly on a building with footings extending below the surface. The vertical displacement can cause crushing action on a building structure, sometimes referred to as barrelling of the support pillars. The vibration from the wave can topple or collapse tall buildings, or at the very least shake the buildings to cause internal damage. Various schemes have been suggested to dampen out the forces of seismic waves It has been known for instance that buildings may be mounted on a series of spherical balls. Such an arrangement clearly assists in dampening out horizontal displacement forces, but not vertical forces. A number of schemes involving springs have been suggested to take into account vertical displacement, but springs have not proven satisfactory, generally because of the size and weight of a structure. Furthermore systems have not been developed to dampen the movement of spring action, and springs by themselves may increase the damage rather than reduce it. Furthermore, for heavy structures the size of the springs must be either enormous or else have little effect.

SUMMARY OF INVENTION

The present invention provides a system wherein pairs of fixed support bases or footings are provided, each support base having a dished top surface in which sits a hardened three dimensional curved member, such as an elliptical shaped member, or one that is a flattened spheroid or pill shaped. On top of these members rests a beam extending between the two footings in each pair. The beam has hardened reversed dished cups to rest on the three dimensional curved members, and between the two supports has post tensioned cables formed within a cambered or arced concrete beam. The building structure is then supported in the centre of each of these concrete beams which are able to deflect a small amount due to the post tensioned steel cables therein. Thus the foundation system provides horizontal movement because the hardened three dimensional curved members in each of the fixed support bases are able to rotate and move horizontally, and also move vertically up and down by deflecting the concrete post tensioned beams.

A self contained grid frame to support a building structure may be provided resting on the post tensioned concrete beams such that shock waves or seismic waves in both horizontal and vertical directions are dampened.

In another embodiment, the present invention provides an elliptical shaped member which is constructed of a top half and a bottom half with a heavy duty spring arranged therebetween to provide a deflection of the elliptical shaped member. This construction takes into account both horizontal and some vertical movement, and in certain types of buildings may be used without a concrete beam with post tensioned members therein.

The present invention provides a foundation system for a building structure comprising a plurality of pairs of fixed support bases arranged to support the structure, the bases in each pair spaced apart and having hardened dished top smooth surfaces; a hardened three dimensional curved member located in the dished top surface of each base; concrete beams having post tensioned members therein, extending between bases in each pair and having hardened reverse dished cups on the lower surface at the ends of the beams, to rest on the curved member located in the dished top surface of each base, and support beams for the building structure on the concrete beams between the ends of the beams.

In another embodiment two concrete beams having post tensioned members therein, are arranged one on top of the other, the lower beam having a reverse camber and the top beam a camber so there is a gap at the center between the beams. The ends of the two beams are hinged together. A single fixed support base supports the lower beam approximately in the center and has a hardened three dimensional curved member located between a hardened dished top surface of the base and a hardened reverse dished cup on the lower beam.

In a further embodiment, the present invention provides a foundation system for a building structure comprising a plurality of fixed support bases arranged to support the structure, the bases having hardened dished top smooth surface; a hardened elliptical shaped member located in each of the dished top surface of the bases, the elliptical shaped member having a top half and a bottom half with a spring arrangement therebetween to provide limited compression, and supports for the building structure having hardened reverse dished cups to rest on the hardened elliptical shaped member in each of the dished top surfaces of the bases.

A still further embodiment provides a hardened elliptical shaped member for building foundation systems, comprising a top half having a hardened semi-elliptical top shell; a bottom half having a hardened semi-elliptical bottom shell; a spring arrangement between the top half and the bottom half maintaining the halves apart and adapted to be compressed, and a circular guide surrounding the spring arrangement attached to one half and adapted to fit within a circular slot in the other half when the elliptical shaped member is compressed.

LIST OF DRAWINGS

In drawings which illustrate embodiments of the invention:

DESCRIPTION OF PREFERRED EMBODIMENTS

Figure 1:
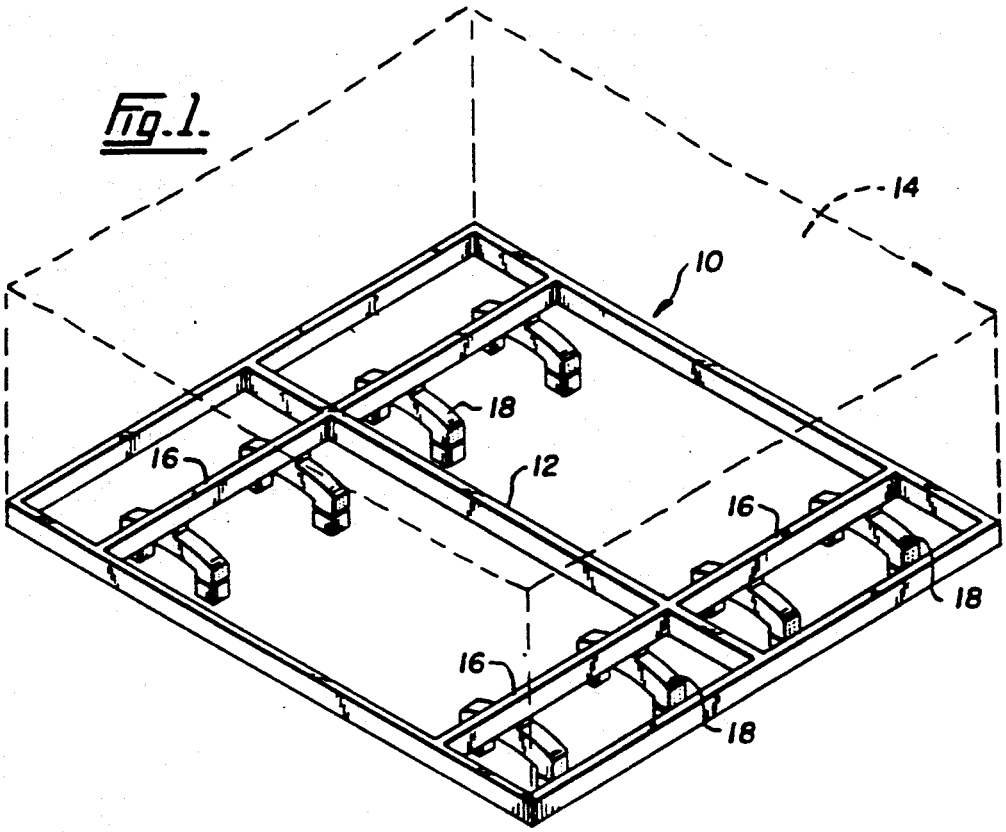
FIG. 1 is an isometric plan view showing a self contained grid frame for supporting a building structure, mounted on a foundation system according to one embodiment of the present invention.

FIG. 1 illustrates a grid frame 10 comprising a plurality or reinforced beams 12, which may be steel or reinforced concrete, to act as a base for a building 14 shown in dotted lines extending up from the grid 10. The network of beams 12 includes support beams 16 which extend across the centre of post tensioned beams 18 forming part of the foundation system for the building.

Figure 2:
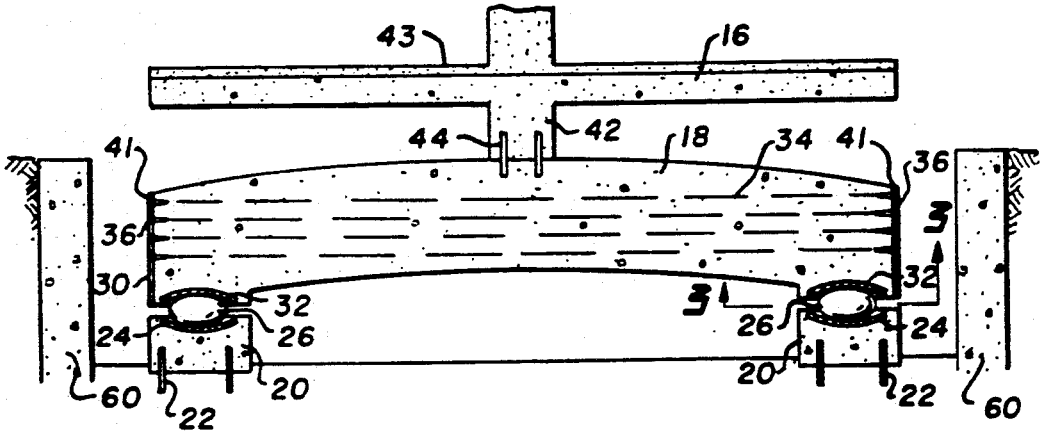
FIG. 2 is a detailed side elevational view showing one embodiment of the foundation system according to the present invention.
Figure 3:
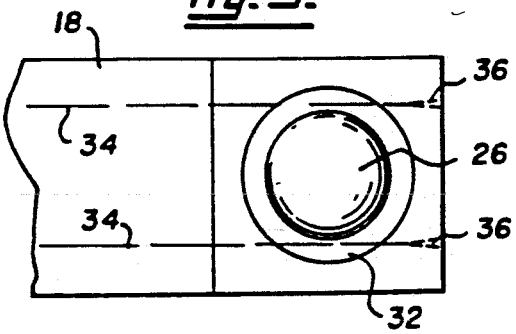
FIG. 3 is a sectional view taken at line 3—3 of FIG. 2.

A detail of the foundation system is illustrated in FIGS. 2 and 3 wherein a pair of concrete footings 20 are spaced at a predetermined distance apart and form a pair of fixed support bases. These bases 20 have rods 22 extending down to footings (not shown) which are of the type common to all building structures. The size and depth of the footings and beams are dependent upon the size and weight of the building and also upon the particular ground conditions. This information is available to all architects, civil engineers and builders On top of the fixed support base 20 is a steel dished member 24 preferably having a smooth surface formed of hardened steel upon which rests a hardened three dimensional curved member 26 which may be an elliptical or an oval member. The member 26 has more than one radius, and allows free lateral movement for 360° without raising the structure.

The concrete beam 18 has supports 30 at each end. The supports have a hardened reverse dished cup 32 made of steel or other suitable material. The concrete beam 18, as can be seen in FIG. 2, is curved and has a plurality of post tensioned members 34 which extend from anchors 36 at each end.

Figure 4:
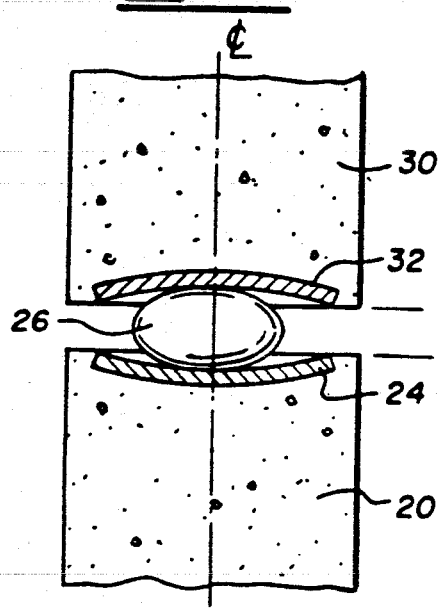
FIGS. 4 and 5 are detailed cross-sectional views through a base according to one embodiment showing the normal position of the elliptical member and the displaced position after horizontal movement of the structure.

FIG. 4 illustrates an elliptical member 26 with the dished cup 32 of the support 30 centred over the top dished surface 24 of the support base 20.

Figure 5:
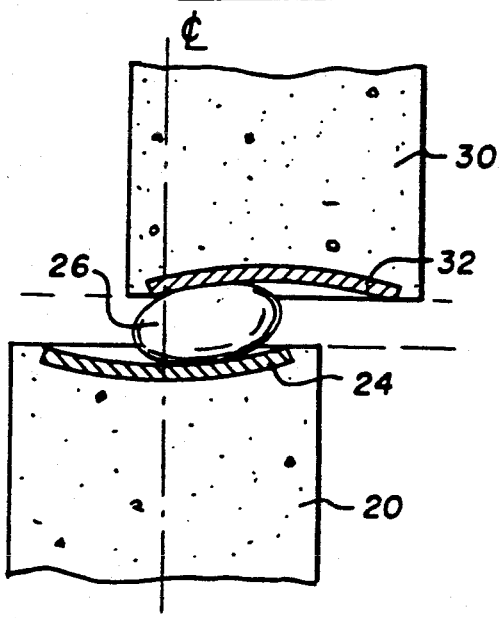

FIG. 5 shows a lateral movement that has occurred between the support 30 and the base 20, the elliptical member 26 moves and the dished cup 32 and top dished surface 24 both slide on the elliptical member 26, but the support 30 does not rise vertically.

Figure 6:
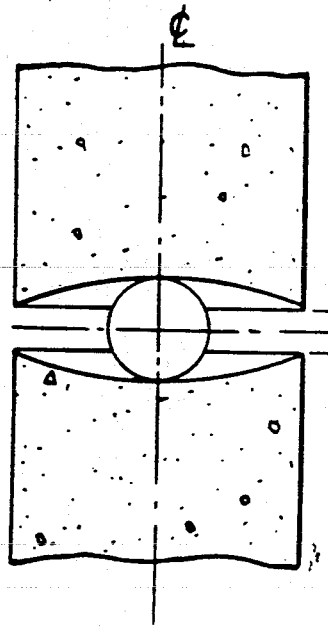
FIGS. 6 and 7 are detailed cross-sectional views through a base showing a spherical wall known in the prior art and indicating how a building must rise up when lateral movement occurs.
Figure 7:
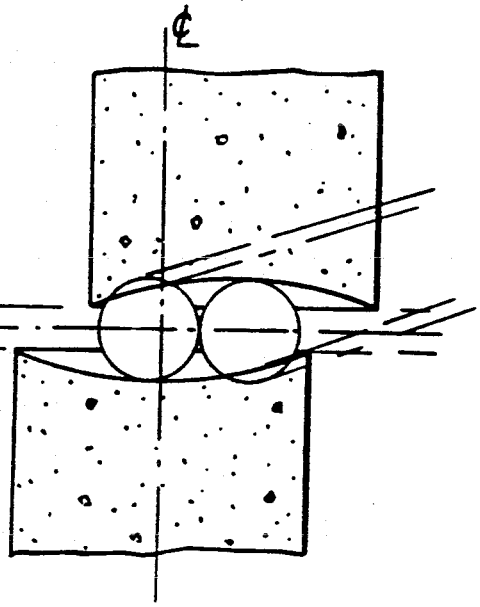

In the prior art when a spherical ball is used in place of the elliptical member, as shown in FIG. 6. A lateral movement of the support over the base, causes the support to rise up as the spherical ball moves. This is illustrated in FIG. 7, which shows a portion of the spherical ball overlapping at the top and the bottom of the support and the base.

Figure 8:
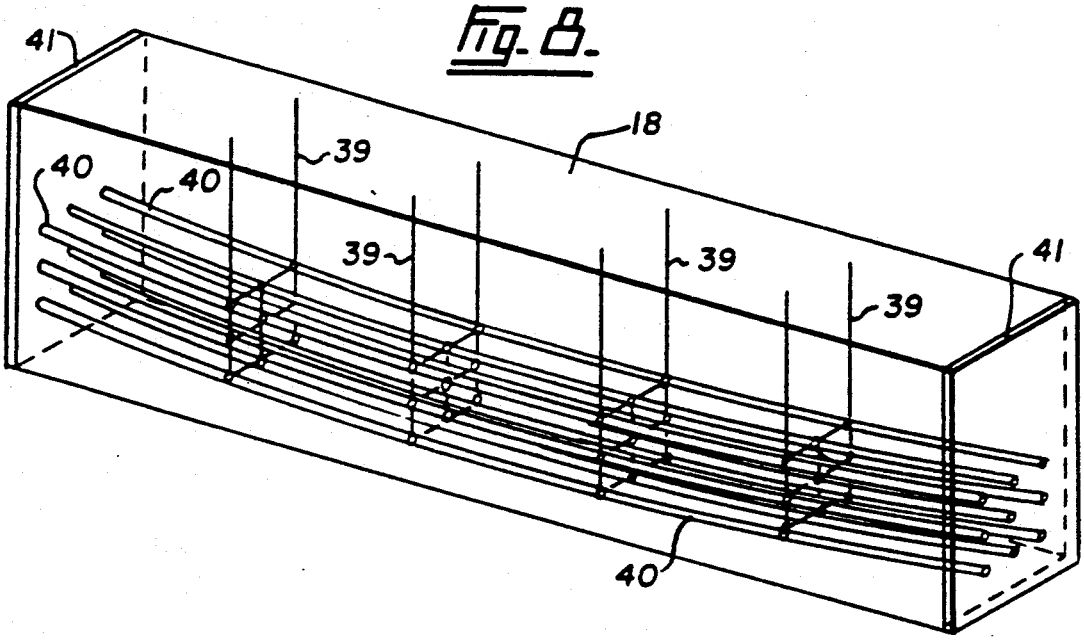
FIG. 8 is an isometric view of a concrete beam with tubes therein prior to post tensioning.

The concrete beam 18 is formed in a mold and is substantially straight as shown in FIG. 8. A series of support brackets 39 are positioned in the mold to contain hollow conduits, sleeves or tubes 40 which are curved or cambered to represent the finished camber required in the beam. The U-shaped support brackets 39 are made of steel reinforcing rod or other similar type of steel rod, and are supported from above in the mold. Slots or holes are provided in the brackets 39 to hold the tubes 40 in the correct shape during the pouring of the concrete beam into the mold. The tubes 40 may be steel or other suitable material.

After the concrete beam 18 has cured and dried, steel cables or tendons 34 are inserted through the tubes 40. The tendons may be made of fiberglass or other suitable material. A steel plate 41 is attached to each end of the beam 18 and the cables or tendons 34 are tensioned until the concrete beam deflects to approximately the same curve initially provided on the tubes 40 and the cables or tendons 34 straighten out. Anchors 36 in the form of cones are attached to the ends of the cables or tendons 34 to hold the post tensioned beam in the curved or cambered configuration. The end steel plates 41 spread the tension from the member 34 to the complete beam.

Whereas nine post tensioned members 34 are shown in FIG. 8, the number of members 34 depends on the dimension of the concrete beam, the weight of building to be supported, the deflection of the beam and other factors. The post tensioning of the members 34 may occur on site or in a shop where most post tensioned beams are formed. Hydraulic jacks tension the cables and cone shaped anchors 36 are wedged into slots in the plates 41 at the beam ends. The length of the beam, and the deflection is determined for specific buildings dependent upon weight of the building.

As shown in FIG. 2 a centre support 42 rests on the centre of the beam 18 and in turn supports the beam 16 which may have a concrete slab 43 thereon. Steel rods 41 are shown extending from the centre support 42 into the top of the centre of the beam 18.

When the three dimensional curved member 26 is elliptical or of similar shape, then it is preferred to use lubrication in the form of graphite lubrication or other suitable lubrication to permit sliding between the elliptical member 26 and the top dished surface 24 of the fixed support base 20 and the reverse dished cup 32 of the beam 18. The surfaces must be maintained clean and rust proof, thus lubrication in the form of graphite or other suitable lubricating oil or grease is provided to ensure that movement can occur if a seismic wave or shock wave occurs. The elliptical member 26 has a rocking and rolling motion which enables the ellipse to go back to its original position once a seismic wave has finished. FIG. 8 illustrates the normal position of the elliptical member 26 between the dished top surface 24 and the reverse dished cup 32, and FIG. 5 shows the situation where the beam 18 has moved horizontally. A combination of rolling and sliding occurs to the elliptical member.

The size of the three dimensional curved member 26, the dished top surface 24 and the reverse dished cup 32 varies depending upon the weight to be supported by the foundation system. Furthermore the size of the beam 18, and the distance between the two fixed support bases 20 is determined by the total weight of the building structure. In the same way the size and number of post tensioned members in each beam 18 is determined by the weight of the building structure above it. The distance between the fixed support bases 20 affects the required deflection of the beam 18. High winds may also affect the design strength of the beam 18. The beams absorb some swaying movement from high winds.

Figure 9:
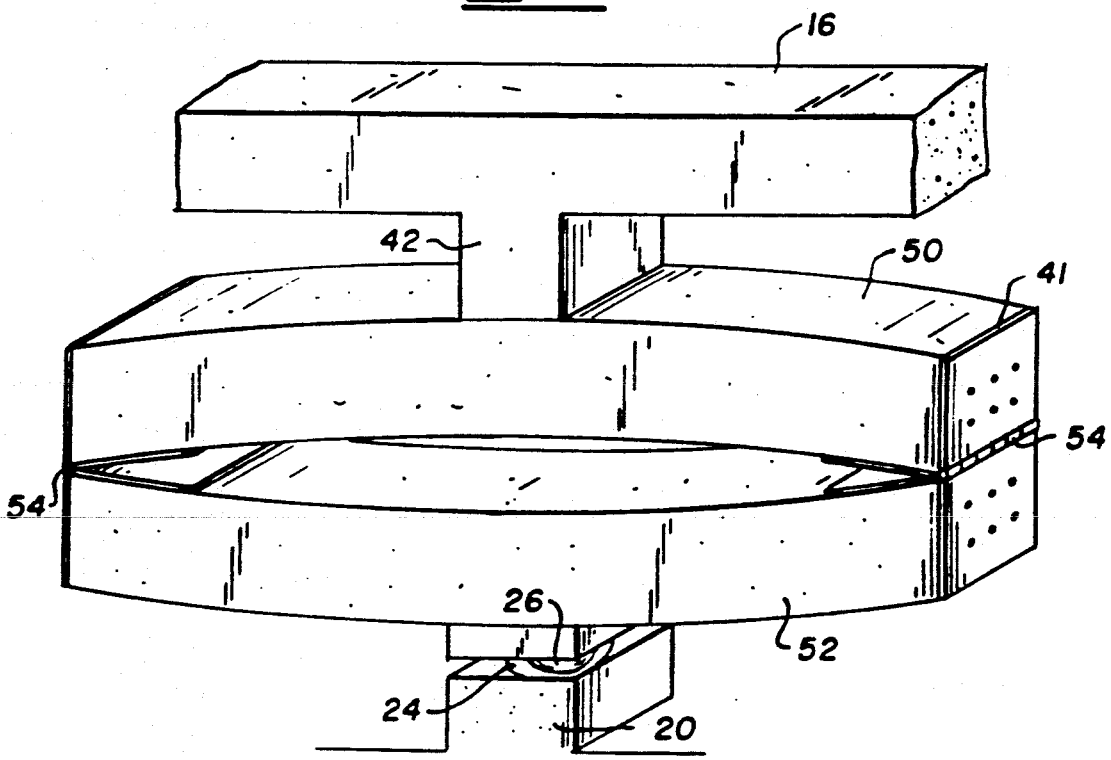
FIG. 9 is an isometric view of a double concrete beam with post tensioned members therein.

A double beam arrangement may be provided in some instances for more deflection as shown in FIG. 9. A top beam 50 and a bottom beam 52 are arranged with reverse camber on the bottom beam 52 in order to provide double the vertical deflection. A hinge 54 between the steel plates 41 joins the ends of the beams 50 and 52 together and allows deflection of both beams simultaneously. Both the beams are post tensioned in the manner described and are designed to retain their camber under full load conditions, i.e. with the building or structure erected. A single base 20 is provided at the centre of the bottom beam 52 with an elliptical member 26 to take into account horizontal movement. The gap 56 between the beams 50 and 52 permits twice the deflection as that of a single beam and therefore allows for greater absorbtion of vertical displacement.

A predetermined space is provided between the ground and the concrete beams so that restriction of both horizontal movement and vertical movement does not occur. The structure is self contained. Retaining walls as shown in FIG. 2 are provided at the sides to ensure earth or rock do not prevent sideways movement of the structure. A sufficient space, generally between about 6 and 12 inches, is provided between the retaining walls and the grid frames to take into account any horizontal movement.

Figure 10:
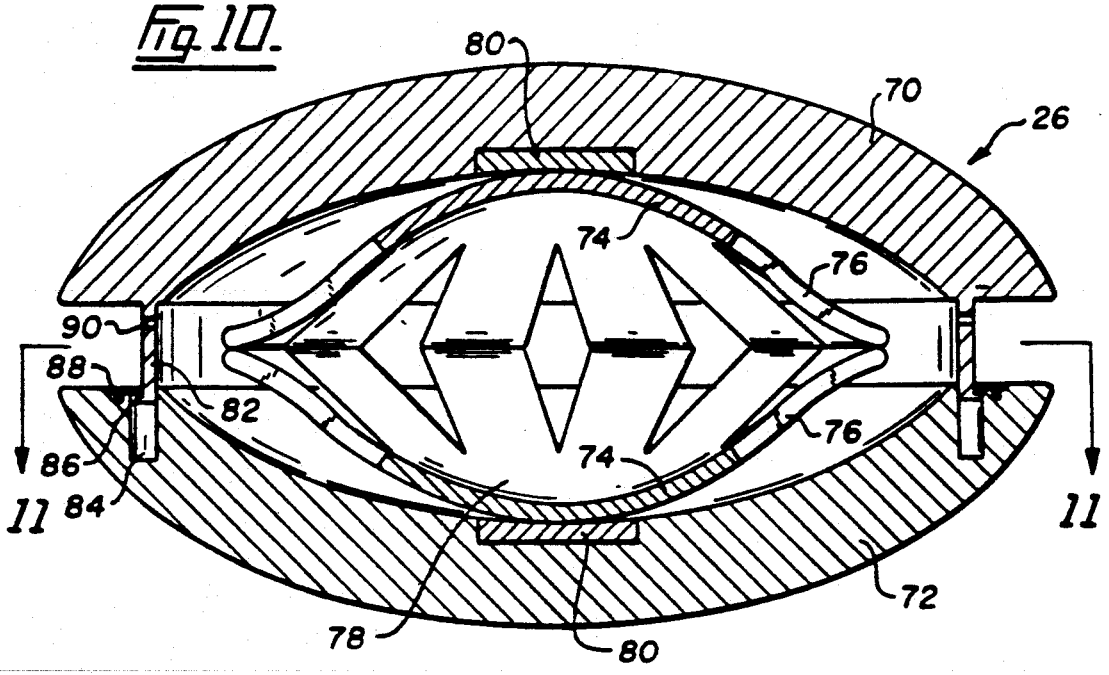
FIG. 10 is a side sectional view through an elliptical shaped member according to one embodiment of the invention.
Figure 11:
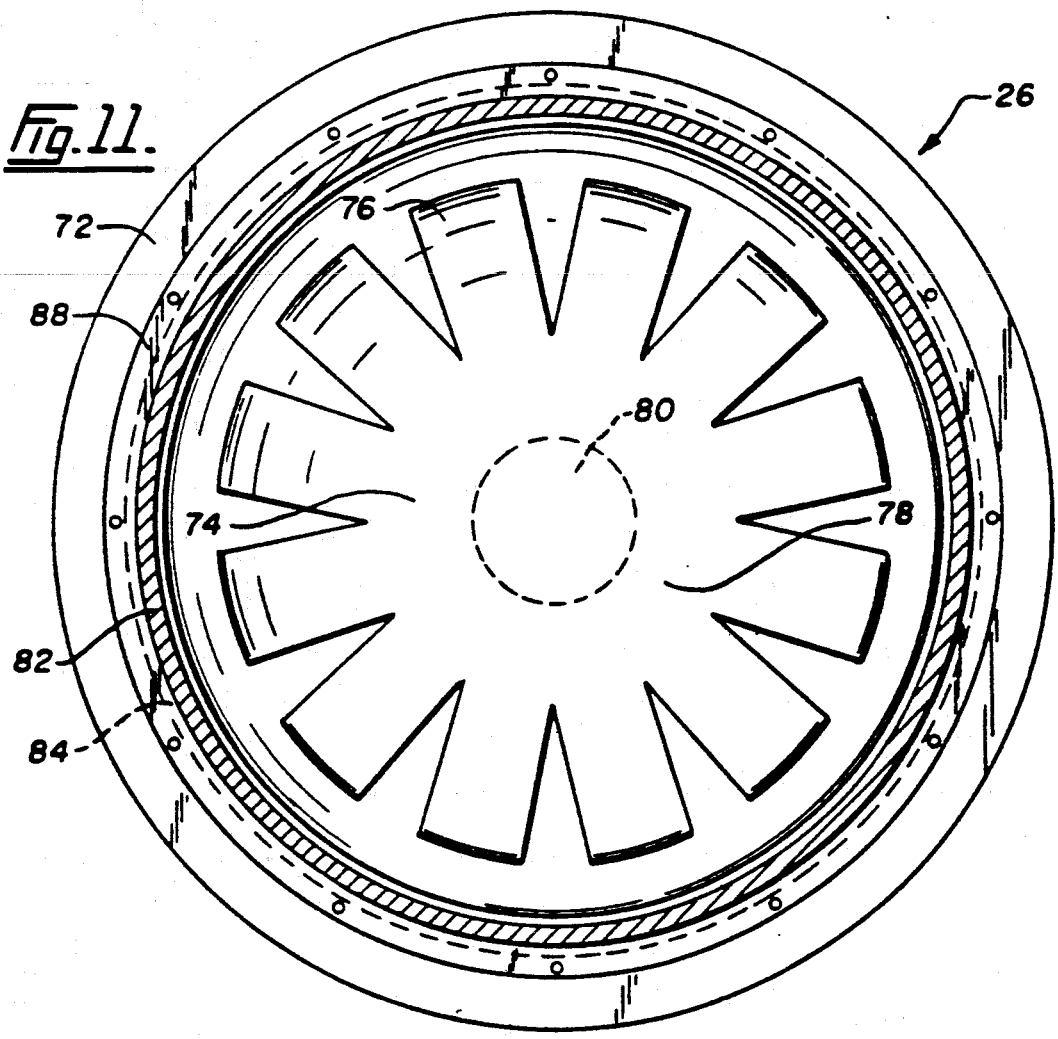
FIG. 11 is a sectional view taken at line 11—11 of FIG. 10.

One embodiment of a hardened elliptical shaped member 26 is shown in FIGS. 10 and 11. The member 26 has two halves, a top half 70 and a bottom half 72. Both halves are substantially the same shape with a semi-elliptical shell made of hardened steel, hollow inside to contain two concave shaped spring members 74 each having fingers 76 so they appear star shaped. The spring members 74 have a cavity 78 between them and have fingers 76 of one spring member 74 supporting the fingers 76 of the other spring member. A steel plate 80 is inserted into the inside top half 70 and bottom half 72 to support the centre of the two spring members 74.

An annular ring 82 is shown attached at its top to top half 70, at a location inwards from the periphery. The ring 82 is of sufficient diameter to allow the two spring members 74 to be compressed and expand without touching the ring 82. A circular slot 84 to take the ring is provided in the bottom half 72 of sufficient depth to contain the ring 82 when the elliptical member is compressed to its maximum, and the two halves touch.

A lip 86 at the bottom of the ring 82 and a plate 88 screwed over a portion of the slot 84 into the bottom half 72 holds the two halves together. Air holes 90 are shown in the ring 82, and further holes may be supplied in the plate 88 and lip 86 so that there is no air pressure build up to prevent compression of the member 76.

The elliptical shaped member flexes under sudden pressure from the ground below. The design of the member is determined by the load factor and the number of members utilized in the erection of the building. The thickness of the spring members 74 and the member of fingers 76 is also determined by the load factor.

In some instances the compressible elliptical member eliminates the need for providing the post tension beams as they take care of both horizontal and vertical motion by themselves, thus eliminating the swaying or oscillation of a building due to an earth tremor.

Lubrication is preferred around the ring 82, the slot 84 and the plate 88. No other areas require lubrication inside the member, although lubrication on the external surfaces is still required.

For a large building with a large surface area, it may be necessary to provide several grid frames, in which case expansion joints must be provided between buildings on each grid frame to take into account the movement between adjacent grid frames.

Various changes may be made to the embodiments shown herein without departing from the scope of the present invention which is limited only by the following claims.

The embodiments of the invention in which an exclusive property or privilege is claimed are defined as follows:

1. A foundation system for a building structure comprising:

a plurality of pairs of fixed bases arranged to support the structure, the bases in each pair spaced apart and having hardened dished top smooth surfaces;

a steel three dimensional curved member of elliptical shape, located in the dished top surface of each base, said curved member being formed in two halves with a spring means therebetween adapted to be compressed a limited amount;

concrete beams, having post tensioned members therein, extending between bases in each pair and having hardened reverse dished cups on the lower surface at the ends of the beams, to rest on the curved member located in the dished top surface of each base, and support means for the building structure on the concrete beams between the ends of the beams.

2. The foundation system according to claim 3 wherein each graphite lubrication is applied to the elliptical shaped member between the hardened dished top surface and the hardened reverse dished cups.

3. The foundation system according to claim 1 wherein the hardened dished top surfaces and the hardened reverse dished cups are formed of steel.

4. The foundation system according to claim 3 wherein the structural members form a self contained grid frame to support a building structure.

5. The foundation system according to claim 1 including structural members extending across the plurality of the concrete beams, supported on the top centre of each concrete beam.

6. The foundation system according to claim 1 wherein the concrete beam with the post tensioned members therein, is curved, having the center of the beam higher than the ends.

7. A foundation system for a building structure comprising:

a plurality of fixed support bases arranged to support the structure, the bases having hardened dished top smooth surfaces;

a hardened elliptical shaped member located in each of the dished top surfaces of the bases, the elliptical shaped member having a top half and a bottom half with spring means therebetween to provide limited compression, said spring means comprising two concave shaped spring members with fingers around the members supporting each other, the center of the spring members supporting the top and bottom halves; and support means for the building structure having hardened reverse dished cups to rest on the hardened elliptical shaped member in each of the dished top surfaces of the bases.

8. A hardened elliptical shaped member for building foundation systems, comprising:

a top half having a hardened semi-elliptical top shell;

a bottom half having a hardened semi-elliptical bottom shell;

a spring means between the top half and the bottom half maintaining the halves apart and adapted to be compressed, said spring means comprising two concave shaped spring members with fingers around the members supporting each other, the center of the spring members supporting the top and bottom halves; and a circular guide surrounding the spring means attached to one half and adapted to fit within a circular slot in the other half when the elliptical shaped member is compressed.

* * * * *